US009416651B2

(12) United States Patent
Al-Rabeh

(10) Patent No.: US 9,416,651 B2
(45) Date of Patent: Aug. 16, 2016

(54) SURFACE CONFIRMATION FOR OPENING DOWNHOLE PORTS USING POCKETS FOR CHEMICAL TRACER ISOLATION

(71) Applicant: Saudi Arabian Oil Company, Dhahran (SA)

(72) Inventor: Majed N. Al-Rabeh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 571 days.

(21) Appl. No.: 13/940,826

(22) Filed: Jul. 12, 2013

(65) Prior Publication Data

US 2015/0013972 A1 Jan. 15, 2015

(51) Int. Cl.
*E21B 34/06* (2006.01)
*E21B 47/09* (2012.01)

(52) U.S. Cl.
CPC ..... *E21B 47/09* (2013.01); *E21B 34/063* (2013.01)

(58) Field of Classification Search
CPC ..... E21B 47/1015; E21B 43/16; E21B 34/14; E21B 47/10; E21B 34/08; E21B 2034/007; E21B 33/124; E21B 47/09; E21B 34/063
USPC ..... 166/250.12
See application file for complete search history.

(56) References Cited

U.S. PATENT DOCUMENTS 958,100 A * 5/1910 Decker ..... E21B 43/082 166/205
3,333,635 A * 8/1967 Crawford ..... E21B 33/134 166/229
4,008,763 A 2/1977 Lowe, Jr.
4,498,543 A * 2/1985 Pye ..... E21B 29/00 166/278
4,828,027 A 5/1989 Schnatzmeyer
5,622,211 A 4/1997 Martin et al.
5,934,371 A 8/1999 Bussear et al.
6,645,769 B2 11/2003 Tayebi et al.
6,715,550 B2 4/2004 Vinegar et al.
6,799,634 B2 10/2004 Hartog et al.
7,259,688 B2 8/2007 Hirsch et al.
8,322,414 B2 12/2012 Al-Gouhi et al.

(Continued)

FOREIGN PATENT DOCUMENTS

WO 2008024448 A1 2/2008
WO 2012057634 A1 5/2012
WO 2013062417 A1 5/2013

OTHER PUBLICATIONS

Barackman, Martin Lee, Diverging flow tracer tests in fractured granite collection, Theses, The University of Arizona, 1986.

(Continued)

*Primary Examiner* — Michael Wills, III
(74) *Attorney, Agent, or Firm* — Bracewell LLP; Constance Gall Rhebergen

(57) ABSTRACT

The invention provides an apparatus and method of using the apparatus for surface confirmation of opening of downhole ports in a downhole environment. The apparatus includes a tubular region that has an inner diameter. The tubular region includes at least two production ports and at least one non-production port. The non-production port includes a housing that has at least one chemical tracer. The apparatus also includes a cutter operable for opening the production ports and non-production port. The apparatus further includes a launcher for launching the cutter and a receiver for receiving the cutter.

20 Claims, 3 Drawing Sheets

(56) References Cited

U.S. PATENT DOCUMENTS

| | | | | |
|---|---|---|---|---|
| 2004/0084186 | A1 | 5/2004 | Allison | |
| 2010/0212891 | A1 | 8/2010 | Stewart et al. | |
| 2011/0127047 | A1* | 6/2011 | Themig | E21B 34/063 166/386 |
| 2011/0290480 | A1 | 12/2011 | Al-Gouhi et al. | |
| 2012/0061559 | A1 | 3/2012 | Ortiz et al. | |
| 2012/0175109 | A1* | 7/2012 | Richard | E21B 43/11 166/250.12 |
| 2012/0292032 | A1* | 11/2012 | Themig | E21B 34/063 166/310 |
| 2012/0305243 | A1 | 12/2012 | Hallundbaek et al. | |
| 2013/0068451 | A1 | 3/2013 | Getzlaf et al. | |
| 2013/0075090 | A1 | 3/2013 | Woiceshyn | |
| 2013/0081807 | A1 | 4/2013 | Dyer et al. | |
| 2013/0091943 | A1* | 4/2013 | Skillingstad | E21B 47/09 73/152.54 |
| 2013/0312965 | A1* | 11/2013 | Themig | E21B 34/14 166/285 |
| 2014/0151052 | A1* | 6/2014 | Themig | E21B 34/063 166/308.1 |

OTHER PUBLICATIONS

Requirements for Robotic Underwater Drills in U.S. Marine Geologic Research, Report from a Workshop, Texas A&M University, May 15, 2003.

PCT International Search Report and The Written Opinion; dated Mar. 25, 2015; International Application No. PCT/US2014/046081; International File Date: Jul. 10, 2014.

* cited by examiner

SURFACE CONFIRMATION FOR OPENING DOWNHOLE PORTS USING POCKETS FOR CHEMICAL TRACER ISOLATION

FIELD OF THE INVENTION

Generally, this invention relates to an apparatus and method for confirmation at the surface level of opening of all downhole ports in a downhole environment. More specifically, it relates to use of chemical tracers for surface detection of the opening of all downhole ports used in stimulating and producing oil or gas wells.

BACKGROUND OF THE INVENTION

As a standard practice in the hydrocarbon industry, oil and gas wells are drilled using various types of drilling mud with a drilling rig. The drilling mud is a fluid made from a recipe of chemicals that serve many purposes such as circulating out the rock cuttings while drilling, lubricating, and cooling the drilling bit to reduce friction while drilling, maintaining a hydrostatic column that will prevent inadvertent production of hydrocarbons during the drilling process, and forming of a filter cake layer that will prevent fluid losses into the formation. However, with all the benefits of drilling mud, it brings a major disadvantage which is formation damage. This damage occurs as the drilling mud contains solids in the recipe which plug the pores of the rock formation and, as a result, significantly reduces the oil or gas production potential. Therefore, it is a common practice to remove this damage using acid treatments after the well is drilled and before the well is put in production mode.

The acid treatment is usually pumped using high pressure pumps located at the surface to the oil or gas bearing formations downhole through a well completion which serves as a conduit for fluid production or injection. There are generally two types of matrix stimulation completions. The first are single port systems, where there is only one large port in any given stage for the acid to be pumped through, and through which hydrocarbons are produced. The second type of matrix stimulation systems, are multiple port systems where there are several smaller ports with the objective of providing a better distribution of the pumped acid across the reservoir. These multiple port systems, like the single port systems, are regarded as permanent well completions. Within the many different multiple port systems available in the market today, are multiple port systems operated using a cutter, launcher, and receiver. The cutters, launchers, and receivers are regarded as permanent parts of this system and serve the specific function of opening these multiple ports (initially run downhole in a closed position) to provide a flow path for the acid treatment directly to the reservoir and then permit producing the oil or gas through these ports.

These downhole, multiple port, oil or gas well stimulation systems operated by movable plugs/cutter devices may include more than one stage along the reservoir. Each stage includes isolation packers to isolate a given stage from the next stage. Between the isolation packers there are a number of downhole ports for the acid to reach the formation and for hydrocarbons to be produced from that particular port. Initially, these ports are run downhole in a closed position. The ports are selectively opened using either isolation balls by themselves or a combination of isolation balls and movable plugs/cutters. There are several multiple port stimulation systems currently available in the market today. Opening of the ports allows for the pumping of acid into the zone of interest and then producing the well through the ports after the stimulation is complete.

For the case of the multiple ports system which include the use of a movable cutter device, at one end of any multiple port stage there is a launcher and at the other end of the stage is a receiver. The purpose of the launcher is to launch a cutter from the launcher end to the receiver end in order to open the series of downhole ports by cutting the closed portions of the ports which extend into the tubular's inner diameter. The cutters are a permanent part of this system. Generally, the cutter is attached to the launcher with screws that are designed to shear under a certain pressure. Such cutters are available in the industry and can be a small piece of tubing or moveable plug with a tapered end, a ball seat inside of it, and seals around the cutter body to seal against the inner diameter of the tubing. After it is launched, the cutter moves from one end of the stage to the other end at a high velocity and cuts the closed portions of the ports that extend into the inner diameter of the tubing, thereby opening the ports in the process. In order to apply pressure to launch the cutter, an isolation ball is typically pumped in the tubing which lands on a ball seat inside the cutter. As pumping continues, the ball seals against the ball seat inside the cutter and pressure builds in the tubing. Once a certain pressure is reached, the screws shear, freeing the cutter to be launched at high velocities to the other end of the stage where it lands and seals against the receiver (opening the ports in the process). In theory, this action should open all ports within that particular stage. After the first stage is opened, a second, upper stage is targeted where another, larger isolation ball is used. The ball lands on the cutter of the upper stage that has a larger ball seat. As pumping continues, pressure in the tubing increases and the cutter is launched to the receiver of the upper stage, and therefore opens the ports of the upper stage. After the ports have been opened in any particular stage, the acid treatment is pumped into the well and exits the completion through the multiple ports and is therefore distributed along the reservoir. The port locations downhole are designed to be spaced out in a way that will distribute the acid along the entire length of any particular stage for maximum acid exposure to the formation. After the acid treatment in all the stages is completed, the well is then flowed back, the balls are collected, and the well flows through the downhole open ports.

Sometimes, due to a variety of reasons, not all of the downhole ports are opened. Currently, the only means for confirming that all downhole ports have been opened is through physical exploring of the well. For instance, means of confirming that all downhole ports are open include the use of production logging tools or temperature sensitive coiled tubing that detects changes in temperature along the open ports (while producing), and thereby confirms the ports are open. However, these methods are expensive, time consuming, and require well intervention which will disrupt the well production and may result in safety concerns. A less expensive, more efficient means of confirming the opening of all downhole ports is needed.

SUMMARY

In one aspect, the invention provides an apparatus for surface confirmation of the opening of all downhole ports in a downhole environment. The apparatus includes a tubular region that has an inner diameter. The tubular region includes at least two production ports and at least one non-production port. The non-production port includes a housing that has at least one chemical tracer. The apparatus also includes a cutter operable for opening the production ports and the at least one non-production port. The apparatus further includes a launcher for launching the cutter and a receiver for receiving the cutter.

In another aspect, the invention provides a method of using the apparatus. The method includes placing the tubular region in a downhole environment. After the tubular region is in place, the cutter is launched through the inner diameter of the tubular region. As a result, the production ports in the tubular region are opened. The at least one non-production port in the tubular region is also opened. The opening of the at least one non-production port releases the at least one chemical tracer in the housing of the non-production port into the inner diameter of the tubular region. The at least one chemical tracer is then detected at a surface region, thus confirming the opening of all of the production ports.

In another aspect, the invention provides an apparatus for surface confirmation of opening of all downhole ports in a downhole environment. The apparatus includes a non-production port having a housing that has at least one chemical tracer. The housing is operable to be opened by a cutter in a tubular region. The at least one chemical tracer is operable to enter the inner diameter of the tubular region upon opening of the housing by a cutter.

DETAILED DESCRIPTION OF THE INVENTION

Figure 1:
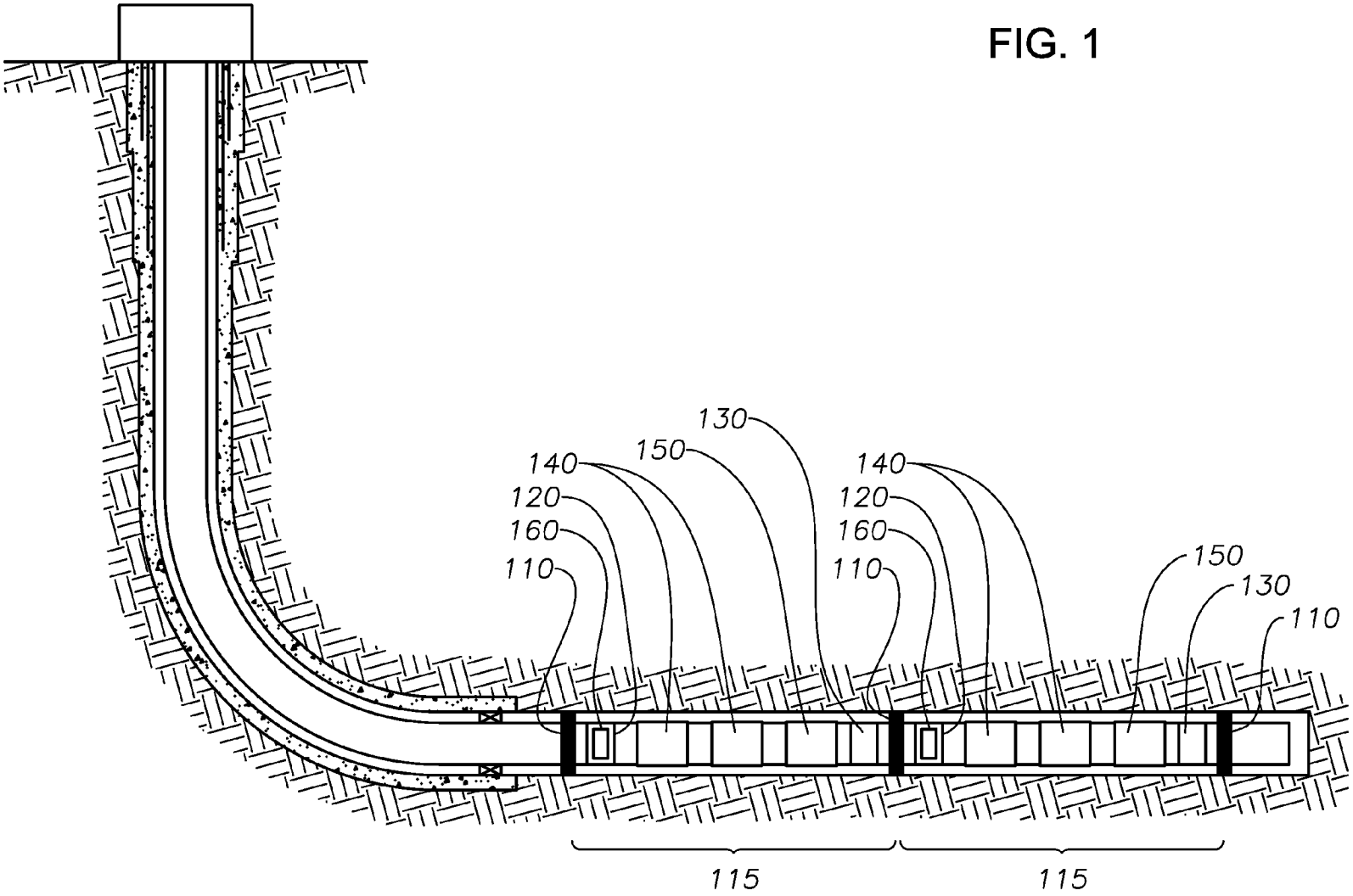
FIG. 1 is a diagram showing the general configuration of an embodiment of the invention.

Although the following detailed description contains many specific details for purposes of illustration, it is understood that one of ordinary skill in the art will appreciate that many examples, variations, and alterations to the following details are within the scope and spirit of the invention. Accordingly, the exemplary embodiments of the invention described herein and provided in the appended figures are set forth without any loss of generality, and without imposing limitations, on the claimed invention.

In one aspect, the invention provides an apparatus for surface confirmation of the opening of all downhole ports in a downhole environment. The apparatus includes a tubular region that has an inner diameter. The tubular region includes at least two production ports and at least one non-production port. The at least one non-production port includes a housing that has at least one chemical tracer. The apparatus also includes a cutter operable for opening the production ports and non-production port. The apparatus further includes a launcher for launching the cutter and a receiver for receiving the cutter.

In another aspect, the invention provides an apparatus for surface confirmation of opening of all downhole ports in a downhole environment. The apparatus includes a non-production port having a housing that has at least one chemical tracer. The housing is operable to be opened by a cutter in a tubular region. The chemical tracer is operable to enter the inner diameter of the tubular region upon opening of the housing by a cutter.

The tubular region is a portion of a permanent well completions system that includes both production ports and at least one non-production port. The ports in a given tubular region are arranged such that the production ports are opened by a cutter before the at least one non-production port is opened. The tubular region includes a tubular.

The production ports are any ports that can be opened using a cutter and used for stimulation of a well or production of oil or gas from a reservoir. Production ports are well known in the industry and a person of skill in the art can select appropriate ports for a given downhole region.

The non-production ports are ports that are not intended for use in stimulation or production. The non-production ports have a housing that encloses at least one chemical tracer. When a non-production port is opened by opening the housing that encloses the at least one chemical tracer, the at least one chemical tracer is released into the inner diameter of the tubular region and carried to the surface with production or other fluids. The housing is designed such that upon opening, the at least one chemical tracer is released only into the inner diameter of the tubular region. The at least one chemical tracer is detected at the surface to confirm the opening of all ports in a given tubular region. In further embodiments, the housing of the non-production port is made of metal or metal alloys such as steel. Care should be taken to ensure that the non-production port housing does not protrude to such an extent that it will result in increased drag, or friction, while running the system downhole. The size of the housing will determine the amount of chemical tracer that can be used. In further embodiments, more than one non-production port is used in one stage for additional accuracy or to meet chemical tracer volume requirements for surface detection. In further embodiments, there are two non-production ports in a single stage or tubular region. In further embodiments, there are three non-production ports in a single stage or tubular region.

In general, the at least one chemical tracer is operable to be transported to a surface region and is capable of being detected at the surface. Chemical tracers can include tracers generally used for gas well applications, tracers for oil well applications, solid tracers, and liquid tracers. In some embodiments, the at least one chemical tracer can include a combination of more than one type of chemical tracer. The preferred tracers will depend on the specific environment where the invention is to be used. Furthermore, each stage in a given hole will have a different chemical tracer, or combination of chemical tracers, to specifically identify which stage has been completely opened upon detection of the chemical tracer at the surface. Care should be taken in selecting the various chemical tracers that are used in different stages in a given hole to ensure that the chemical tracers can be distinctly detected at surface. The chemical tracers are detected at the surface once a sample is taken from the well flow back by analyzing the samples in laboratories. Regarding the amount of tracers to be used, as much tracer chemical should be used as permitted by the housing volume to ensure sufficient quantities for detection at surface.

The cutter is any cutter operable to cut the production ports and non-production ports in a tubular region. Cutters are well known in the industry and a person of skill in the art can select appropriate cutters for a given tubular region.

The launcher is any launcher operable to launch a cutter in a tubular region. Launchers are well known in the industry and a person of skill in the art can select appropriate launchers for a given tubular region.

The receiver is any receiver operable to receive a cutter in a tubular region. Receivers are well known in the industry and a person of skill in the art can select appropriate receivers for a given tubular region.

In many instances, multiple port systems can include cutters, launchers, and receivers provided as part of a package in a multiple port system.

In another aspect, the invention provides a method of using the apparatus. The method includes placing the tubular region in a downhole environment. After the tubular region is in place, the cutter is launched through the inner diameter of the tubular region. As a result, the production ports in the tubular region are opened. The at least one non-production port in the tubular region is also opened. The opening of the at least one non-production port releases the at least one chemical tracer in the housing of the at least one non-production port into the inner diameter of the tubular region. The at least one chemical tracer is then detected at a surface region, thus confirming the opening of all of the production ports.

In another embodiment, the method can further include placing a second tubular region in the downhole environment. A second cutter is launched through the inner diameter of the second tubular region. The production ports in the second tubular region are opened. The at least one non-production port in the second tubular region is opened. The opening of the at least one non-production port releases a second at least one chemical tracer in the housing of the non-production port into the inner diameter of the second tubular region. The second at least one chemical tracer is detected at the surface region, thus confirming the opening of all of the production ports in the second tubular region.

In further embodiments, the chemical tracer and the second chemical tracer are different, thus allowing confirmation of which tubular regions have all production ports opened. In further embodiments, the chemical tracer and the second chemical tracer are both solids. In further embodiments, the chemical tracer and the second chemical tracer are both liquids.

One of skill in the art will understand that a number of tubular regions can be placed in a given downhole region. For example, two tubular regions 115 are shown in FIG. 1. In further embodiments, there are at least two tubular regions in one well. In further embodiments, there are at least three tubular regions in one well. In further embodiments, there are at least four tubular regions in one well.

In some embodiments, the apparatus further comprises isolation devices. In some embodiments, the isolation devices are swell packers or mechanical packers located at distal ends of the tubular region, as shown in FIG. 1. FIG. 1 generally shows an embodiment of the invention. As shown in FIG. 1, swell packers 110 are located on the distal ends of each tubular region 115, framing the launchers 120 and receivers 130 in each tubular region 115. Each tubular region has production ports 140 and non-production port 150.

Figure 2:
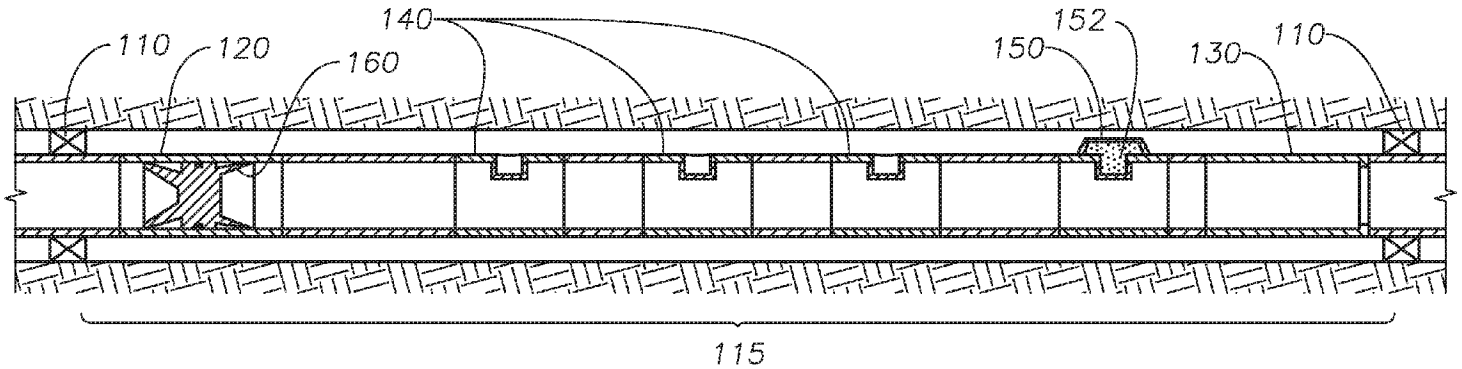
FIG. 2 is a schematic of the tubular region according to an embodiment of the invention.

FIG. 2 shows an exemplary embodiment of an apparatus for surface confirmation of opening of downhole ports in a downhole environment. FIG. 2 shows one tubular region 115 in accordance with an embodiment of the invention. As can be seen, the tubular region has swell packers 110 at the distal ends of the tubular region. Production ports 140 are positioned such that they will be opened by cutter 160 when launched by launcher 120. After production ports 140 are opened, non-production port 150 will be opened and release chemical tracer 152.

Figure 3B:
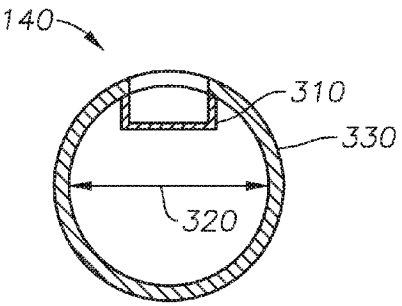
FIGS. 3*a* and 3*b* are schematics of a production port according to an embodiment of the invention.
Figure 3A:
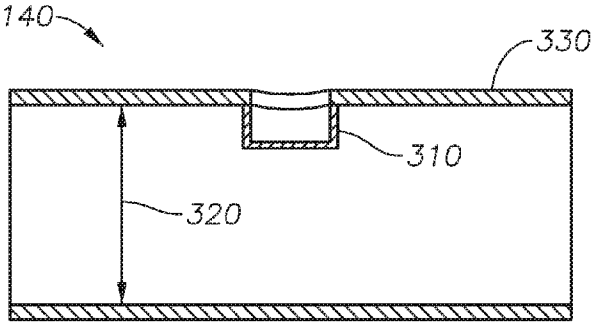

FIGS. 3*a* and 3*b* show an exemplary production port according to an embodiment of an invention. As shown in FIG. 3*a*, which is a side view of a production port 140, a portion 310 extends into the inner diameter 320 of the tubular 330. FIG. 3*b* is a front view of the production port, with portion 310 extending into the inner diameter 320 of the tubular 330. Portion 310 is sheared by the cutter, thus opening production port 140.

Figure 4A:
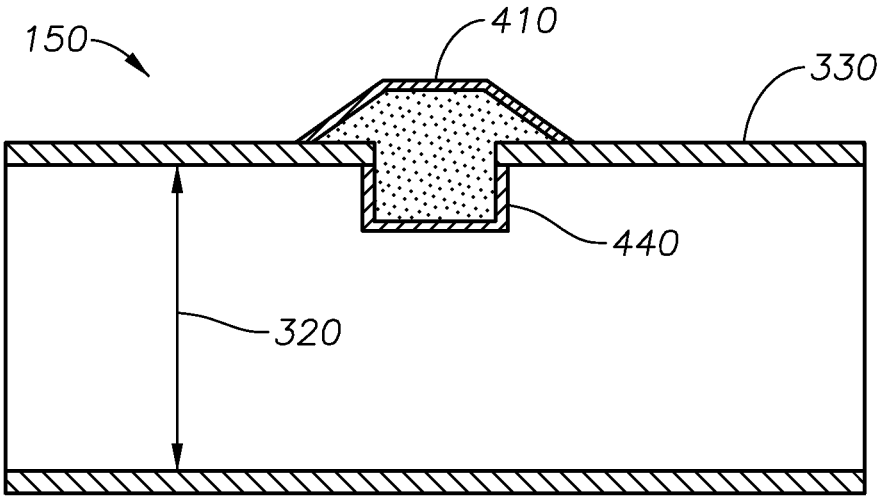
FIGS. 4*a* and 4*b* are schematics of a non-production port according to an embodiment of the invention.
Figure 4B:
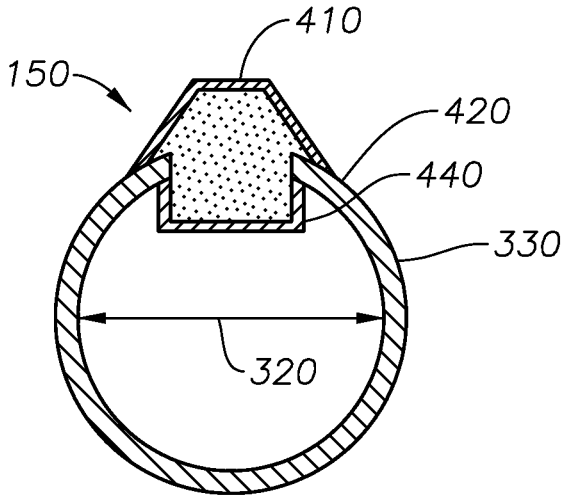

FIGS. 4*a* and 4*b* show an exemplary non-production port according to an embodiment of the invention. As shown in FIG. 4*a*, which is a side view of a non-production port 150, a housing 410 containing chemical tracer extends on the outer diameter 420 of the tubular 330. FIG. 4*b* is a front view of the production port, with portion 440 extending into the inner diameter 320 of the tubular 330. Portion 440 is sheared by the cutter, thus opening housing 410 and releasing chemical tracer into the tubular inner diameter 320, which is then transported to the surface via the well flow back.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a," "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

As used herein and in the appended claims, the words "comprise," "has," and "include" and all grammatical variations thereof are each intended to have an open, non-limiting meaning that does not exclude additional elements or steps.

What is claimed is:

1. An apparatus for surface confirmation of the opening of all downhole ports in a downhole environment, the apparatus comprising:

a tubular region comprising an inner diameter;

the tubular region further comprising at least two production ports and at least one non-production port;

the at least one non-production port comprising a housing having at least one chemical tracer, wherein the housing extends radially outward on an outer diameter of the tubular region;

a cutter operable for opening the at least two production ports and the at least one non-production port;

a launcher for launching the cutter; and a receiver for receiving the cutter.

2. The apparatus of claim 1, wherein the apparatus further comprises isolation devices.

3. The apparatus of claim 2, wherein the isolation devices are swell packers located at distal ends of the tubular region.

4. The apparatus of claim 2, wherein the isolation devices are mechanical packers located at distal ends of the tubular region.

5. The apparatus of claim 1, wherein the housing of the at least one non-production port comprises metal.

6. The apparatus of claim 1, wherein the at least one chemical tracer is operable to be transported to a surface region in production fluids.

7. The apparatus of claim 1, wherein the at least one chemical tracer is a liquid.

8. The apparatus of claim 1, wherein the at least one chemical tracer is a solid.

9. The apparatus of claim 1, wherein the chemical tracer includes a combination of more than one type of chemical tracer.

10. A method of using the apparatus of claim 1, comprising the steps of:

placing the tubular region in a downhole environment;

launching the cutter through the inner diameter of the tubular region;

opening the at least two production ports in the tubular region;

opening the at least one non-production port in the tubular region;

the opening of the at least one non-production port releases at least one chemical tracer in the housing of the at least one non-production port into the inner diameter of the tubular region; and detecting the at least one chemical tracer at a surface region.

11. The method of claim 10, further comprising the steps of:

placing a second tubular region in the downhole environment;

launching a second cutter through the inner diameter of the second tubular region;

opening the at least two production ports in the second tubular region;

opening the at least one non-production port in the second tubular region;

the opening of the at least one non-production port in the second tubular region releases a second at least one chemical tracer in the housing of the at least one non-production port into the inner diameter of the second tubular region; and detecting the second at least one chemical tracer at a surface region.

12. The method of claim 11, further wherein the at least one chemical tracer and the second at least one chemical tracer are different.

13. The method of claim 11, further wherein the chemical tracer and the second chemical tracer are both solids.

14. The method of claim 11, further wherein the chemical tracer and the second chemical tracer are both liquids.

15. An apparatus for surface confirmation of opening of all downhole ports in a downhole environment, the apparatus comprising:

at least one non-production port comprising a housing having at least one chemical tracer, wherein the housing extends radially outward on an outer diameter of a tubular region;

the housing operable to be opened by a cutter in the tubular region;

the at least one chemical tracer operable to enter the inner diameter of the tubular region upon opening of the housing by a cutter.

16. The apparatus of claim 15, wherein the housing of the at least one non-production port comprises metal.

17. The apparatus of claim 15, wherein the chemical tracer is operable to be transported to a surface region in production fluids.

18. The apparatus of claim 15, wherein the chemical tracer is a liquid.

19. The apparatus of claim 15, wherein the chemical tracer is a solid.

20. The apparatus of claim 15, wherein the chemical tracer includes a combination of more than one chemical tracer.

* * * * *